US005622286A

United States Patent [19]

Renault

[11] Patent Number: 5,622,286

[45] Date of Patent: Apr. 22, 1997

[54] MANUALLY ACTUATED DISPENSING UNIT FOR SPRAYING A LIQUID IN THE FORM OF DROPLETS IN A VIRTUALLY CONTINUOUS MANNER

[75] Inventor: Philippe Renault, Chaville, France

[73] Assignee: L'Oreal, Paris, France

[21] Appl. No.: 380,660

[22] Filed: Jan. 30, 1995

[30] Foreign Application Priority Data

Jan. 28, 1994 [FR] France ..... 94 00988

[51] Int. Cl.[6] ..... B65D 88/54

[52] U.S. Cl. ..... 222/321.2; 222/321.8; 222/383.1

[58] Field of Search ..... 222/321.2, 321.8, 222/383.1

[56] References Cited

U.S. PATENT DOCUMENTS

| | | | |
|---|---|---|---|
| 4,271,990 | 6/1981 | Kutik et al. . | |
| 5,068,099 | 11/1991 | Sramek | 222/321.2 |
| 5,242,090 | 9/1993 | Reyss | 222/321.8 |
| 5,316,185 | 5/1994 | Meenan | 222/321.8 |

FOREIGN PATENT DOCUMENTS

| | | | |
|---|---|---|---|
| 0274620 | 7/1988 | European Pat. Off. . | |
| 385077 | 9/1990 | European Pat. Off. | 222/321.8 |
| 0466544 | 1/1992 | European Pat. Off. . | |
| 0497709 | 8/1992 | European Pat. Off. . | |
| 0605275 | 7/1994 | European Pat. Off. . | |
| 2320789 | 3/1977 | France . | |
| 2517639 | 6/1983 | France . | |
| 2675403 | 10/1992 | France . | |
| 1099695 | 1/1968 | United Kingdom . | |
| WO93/25447 | 12/1993 | WIPO . | |

*Primary Examiner*—Gregory L. Huson
*Attorney, Agent, or Firm*—Young & Thompson

[57] ABSTRACT

This unit ensures the dispensing of a liquid in the form of droplets in a virtually continuous manner and a comprises a reservoir (2) containing the liquid to be sprayed, this reservoir communicating with a feeder duct (3) of a precompression pump (4) provided with a delivery duct (5) communication with a spraying nozzle (8). There is a manually-activated pushbutton (7) for actuating the pump and spraying this liquid, this pump comprising a cylindrical body (6) joined to the feeder duct (3), and a piston (10) capable of sliding in a portion with a diameter of the body (6) under the actuation of the pushbutton (7) against a spring (11) along a stroke C. A one-way valve prevents the return of the liquid. A flexible closure (12, 13) releases a dispensing duct (14) in the pump when the pressure obtaining in the body following the actuation of the pushbutton (7) exceeds a specified value.

17 Claims, 4 Drawing Sheets

Figure 1:
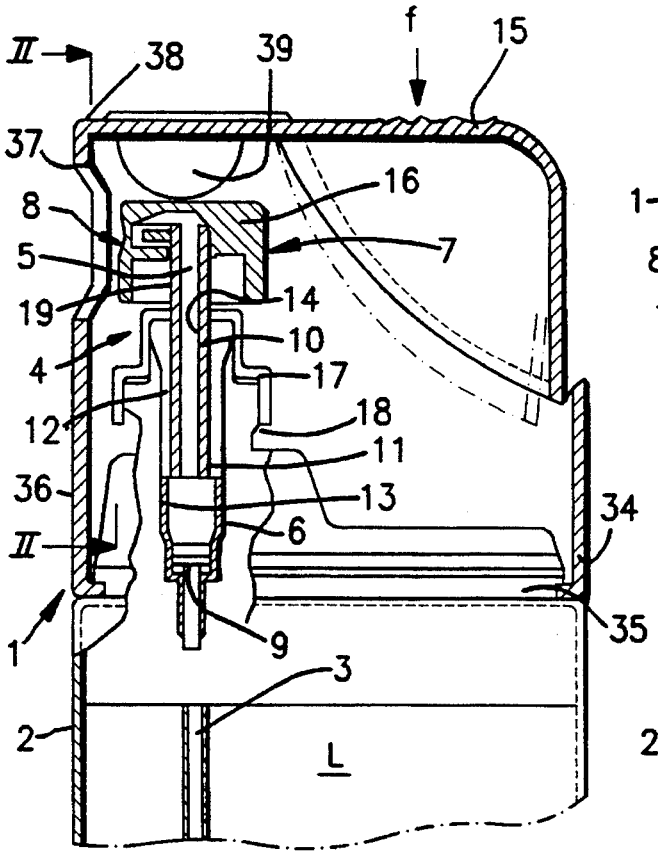

MANUALLY ACTUATED DISPENSING UNIT FOR SPRAYING A LIQUID IN THE FORM OF DROPLETS IN A VIRTUALLY CONTINUOUS MANNER

The present invention relates to a new dispensing unit for spraying a liquid in the form of droplets, in a virtually continuous manner, this unit being provided with a precompression pump. This unit is intended in particular for spraying a hair lacquer.

Dispensers of hair lacquers ensuring their spraying in the form of an aerosol are known. Such a dispenser is constituted by a container which contains the liquid lacquer to be sprayed, and which is itself provided with a cup comprising a dispensing valve surmounted by a push button comprising a spraying nozzle. This lacquer is sprayed in a continuous manner under the action of a pressurized propellant gas which is generally inflammable.

A hair lacquer is intended to be sprayed in a continuous manner to the dry scalp so as to fix a finished hairstyle.

With such a dispenser in the form of an aerosol can and, for example, such as that described in the our FR-A 2517639, a lacquer whose average granulometric size is of the order of approximately 45 to 50 μm can be sprayed.

Unfortunately, the use of a propellant gas is becoming more and more controversial from the economic, ecological and safety points of view. Thus it is necessary to find rapidly a solution for replacing these propellant gas dispensers.

Because of these considerations, the present invention aims to dispense a liquid, a hair lacquer in particular, in spraying conditions approximating as closely as possible to those obtained by means of a propellant gas dispenser, but without using any propellant gas.

Moreover, it is known to provide dispensers of liquid hair styling products, generally termed "hair sprays", and which are intended to saturate the hair, before or during its styling; these dispensers include a reservoir for the product to be dispensed, which is surmounted by a manual-action dispensing pump.

Such a manual action pump dispenser of hair sprays is described for example, in FR-A 2675403 in which the actuation of the dispensing pump is effected by means of a lever arm which is depressed by the user. On each actuation a dose of the product, generally exceeding 200 μl, is ejected. The operating stroke of the pump is relatively long (exceeding 7 mm).

As is known, in contrast to the dispensers of lacquer, a hair spray dispenser of this kind is used discontinuously by saturating the hair, tress by tress, with several doses of the product.

The hair sprays sprayed by the known pump dispensers have wetting properties, because of their granulometric size exceeding approximately 70 μm, and because of this they cannot be used for fixing a finished head of hair, as is the case with a hair lacquer which is sprayed continuously under the action of a pressurized propellant gas.

The pump usually used for dispensing a hair spray is a precompression pump which generally has two chambers into which the liquid to be sprayed passes successively: these are a first chamber into which the liquid to be sprayed is introduced via a suction valve and wherein it is subjected to a precompression by means of a piston that is generally actuated manually from the outside against the action of resilient restoring means, and a second chamber connected to a nozzle for spraying the liquid. The precompression of the liquid in the first chamber is intended to ensure a high dispensing quality for the product from the start of the spraying. Such a precompression pump is described, for example, in FR-A 2 343 137, FR-A 2 460 164, EP-A1 0309 010, EP-A1 0345 132 and EP-A1 0346 167.

Amongst the precompression pumps currently on the market, no precompression pump exists which could ensure a satisfactory granulometric size for a hair lacquer, that is to say a granulometric size whose average diameter of the particles is at most, equal to 65 μm.

There thus remains the need for a new hair lacquer dispensing unit ensuring spraying without any propellant gas and which to the greatest extent possible approximates to that of the known lacquer propellant gas dispensers and ensures in particular a granulometric size of, at most, 65 μm, and virtually continuous dispensing.

The expert will know that in order to reduce the granulometric size of a hair spray, it is necessary to create a high precompression of the pump which, as far as the user is concerned, entails too great a force for operating the pump. Moreover, a virtually continuous spraying requires successive, rapid actuations of the pump, which then leads to a short piston stroke. If, in these conditions, it is intended to ensure the dispensing of a given liquid dose, it will be necessary to increase the diameter of the piston, which will lead to an even greater increase in the force to be provided by the user for actuating the pump; this would discourage the expert from committing himself to this solution.

After extensive research, we have found that it was possible to obtain spraying of an acceptable quality of a hair lacquer by means of a modified precompression pump. Moreover, it has been found, surprisingly, that by means of a dispensing unit provided with such a pump, it was possible to obtain virtually continuous spraying, that is to say, one approximating to the greatest possible extent to the spraying characteristics produced by a propellant gas dispenser.

Our research has been concerned with the force necessary for operating the pump, the value of the precompression obtaining in the pump body during each displacing of a dose of the liquid, the diameter of the piston, the operating stroke, the dose dispensed, and the efficiency of the pump.

Surprisingly, we have found that by a judicious adjustment of these parameters, it was possible to obtain a homogeneous spraying with a satisfactory granulometric size for a hair lacquer, and this in a virtually continuous manner.

One aspect of the present invention provides a unit for dispensing a liquid capable of spraying this liquid in the form of droplets in a virtually continuous manner, comprising a reservoir containing the liquid to be sprayed, this reservoir communicating with a feeder duct of a precompression pump provided with a delivery duct which communicates with a spraying nozzle; means for actuating the pump and for spraying this liquid, this pump comprising a cylindrical body joined to the said feeder duct, and a cylindrical piston capable of sliding in a portion with a diameter $\phi$ of the pump body under the actuation of the actuating means against resilient restoring means along a stroke C; means for preventing the return of the liquid into the feeder duct; and flexible closing means provided for releasing a dispensing duct in the pump when the pressure P obtaining inside the pump body following the actuation of the actuating means exceeds a specified value, this pump having an efficiency R and delivering on each actuation, a dose D of the liquid; wherein the stroke C of the piston is in the range of from 2 to 5 mm.

The theoretical dose of the dispensed liquid is calculated as follows:

$$D\,(\text{theoretical}) = \frac{\pi}{4}\,\phi^2 \times C$$

The efficiency R is defined by the expression $$R = \frac{D\,(\text{the dose actually delivered})}{D\,(\text{theoretical})}$$

By choosing a pump having a high efficiency, actuation of the pump may require only a small stroke C, which facilitates a virtually continuous dispensing operation.

Advantageously, the stroke C of the piston is comprised in the range of 2 to 3.5 mm for a dose of 125 to 170 μl.

Moreover, the ratio $\phi/C$ may be at least equal to 1.45 for a dose D comprised in the range of 110 to 170 μl. These doses correspond in particular to those used for a hair lacquer.

A second aspect of the present invention provides a unit for dispensing a liquid capable of spraying this liquid in the form of droplets in a virtually continuous manner, comprising a reservoir containing the liquid to be sprayed, this reservoir communicating with a feeder duct of a precompression pump provided with a delivery duct which communicates with a spraying nozzle; means for actuating the pump and for spraying this liquid, this pump comprising a cylindrical body joined to the said feeder duct, and a cylindrical piston capable of sliding in a portion with a diameter $\phi$ of the pump body under the actuation of the actuating means against resilient restoring means along a stroke C; means for preventing the return of the liquid into the feeder duct; and flexible closing means provided for releasing a dispensing duct in the pump when the pressure P obtaining inside the pump body following the actuation of the actuating means exceeds a specified value, this pump having an efficiency R and delivering on each actuation, a dose D of the liquid; wherein the ratio $\phi/C$ is at least equal to 1.45 for a dose in the range of from 110 to 170 μl.

The actuating means are preferably associated with a reducing system in the form of a lever arm which makes it possible to reduce the force necessary for actuating the pump. Advantageously, the reducing ratio of the lever arm is comprised in the range of 1 to 5 and preferably from 2 to 3.

Advantageously the ratio $D/\phi^2$ is at most equal to 3.3 and preferably at most equal to 2.5 for a ratio $D/\phi.C$ comprised in particular in the range of 4.5 to 5.5.

Preferably, the efficiency R of the pump as defined above is higher than 50% and more particularly higher than 75%.

Advantageously, the diameter $\phi$ of the portion of the pump body that is in contact with the piston is comprised in the range of 3 to 16 mm.

During the actuation of the pump, the pressure P obtaining inside the pump body that is necessary for releasing the dispensing duct for the liquid is at least equal to $5\times10^5$ Pa.

According to a first variant of the invention, the spraying nozzle is mounted on a movable push button which constitutes the actuating means, the push button being connected to an actuating and spraying stem emerging from the pump body.

According to a second variant of the invention, the unit for dispensing the liquid includes a nozzle mounted in the pump body, the actuating means then being constituted by a stem having a first end and a second end emerging from the pump body and connected via the first end inside the pump body to the piston, the second end of the stem being free outside the pump and in contact with the lever arm.

According to a third variant of the invention, the unit for dispensing the liquid includes a nozzle mounted in the reducing system which includes a tube connected to a stem emerging from the pump body, and which causes the delivery duct of the pump body and the nozzle to communicate.

The dispensing unit in accordance with the present invention is particularly suitable for spraying a hair lacquer. It can, however, also be used for spraying other liquids with film-forming properties, or be used in the field of cosmetics and personal hygiene (sun lotions, deodorants).

Thus, the present invention relates also to a hair lacquer dispenser comprising the dispensing unit defined above.

The dispensing unit in accordance with the present invention described above permits a repetitive and fast operation of the means for actuating the dispensing pump; the spraying obtained then approximates to continuous spraying with a granulometric size at most equal to 65 μm, and is particularly suitable for fixing a head of hair after styling.

Figure 2:
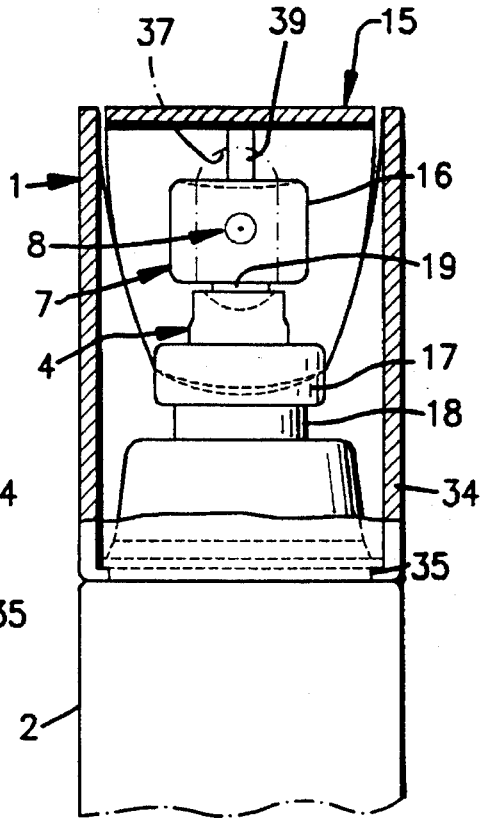
Figure 3:
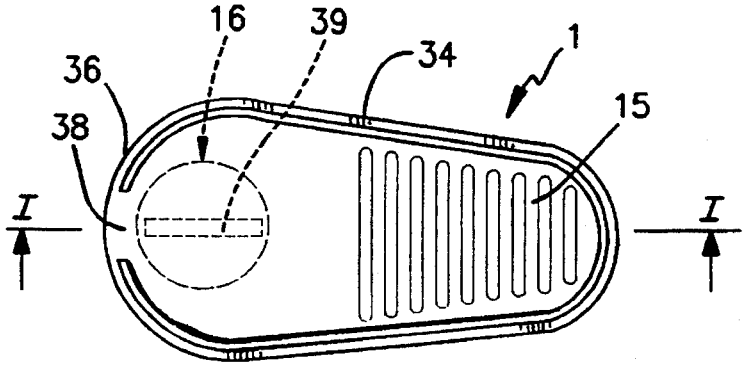
Figure 4:
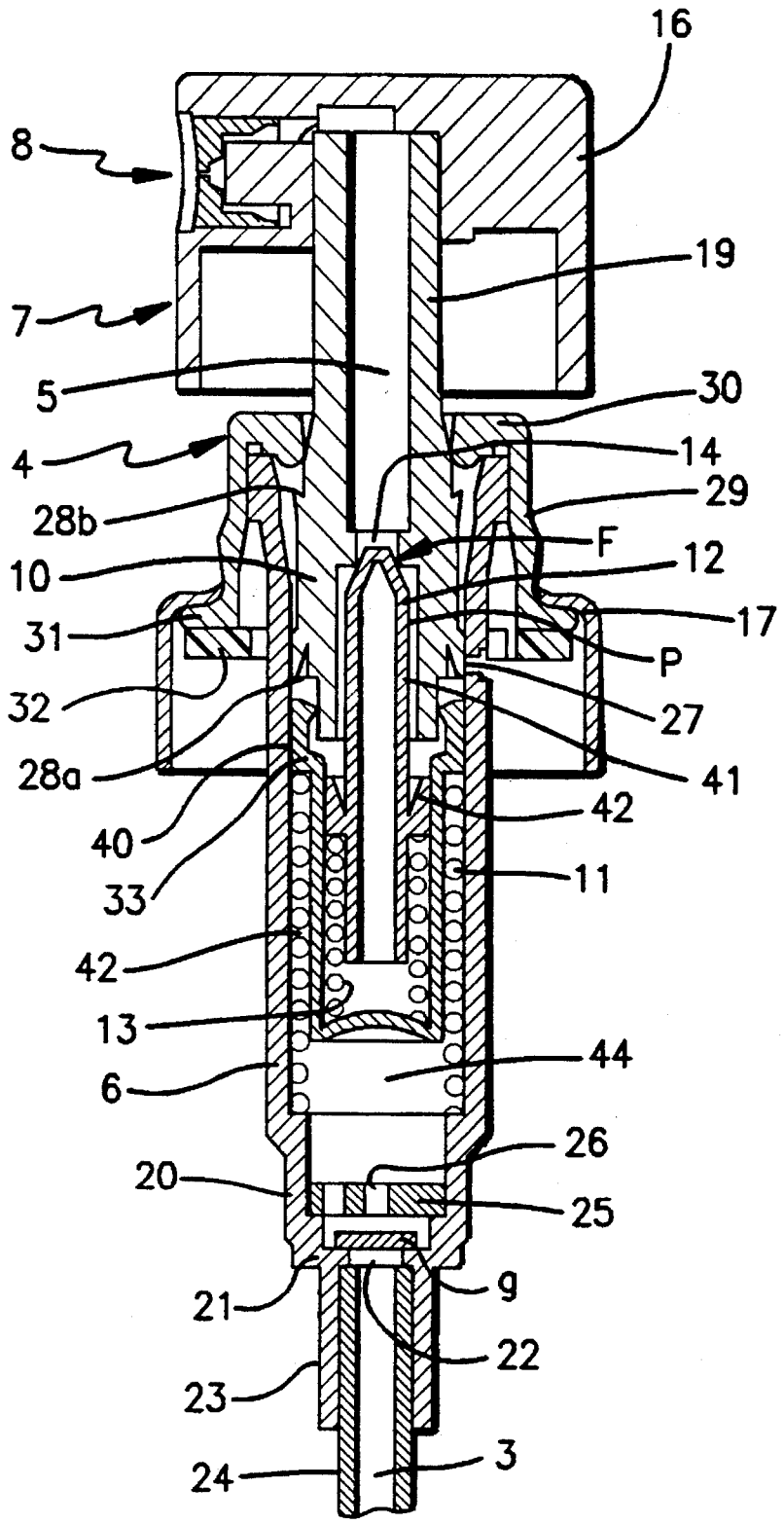

The following description of three variants of the embodiment of the dispenser of the invention is given by way of illustration without being restrictive and with reference to the attached drawings and will allow the invention to be more readily understood. In these drawings:

FIG. 1 shows a longitudinal sectional view of a dispensing unit in accordance with the invention, according to a first variant of the embodiment, FIG. 2 shows a longitudinal sectional view along line II—II of FIG. 1, FIG. 3 is a top view of the dispensing unit according to FIG. 1, FIG. 4 is an enlarged view in a longitudinal section of the precompression pump of the dispensing unit of FIG. 1 provided with actuating and spraying means.

Figure 6:
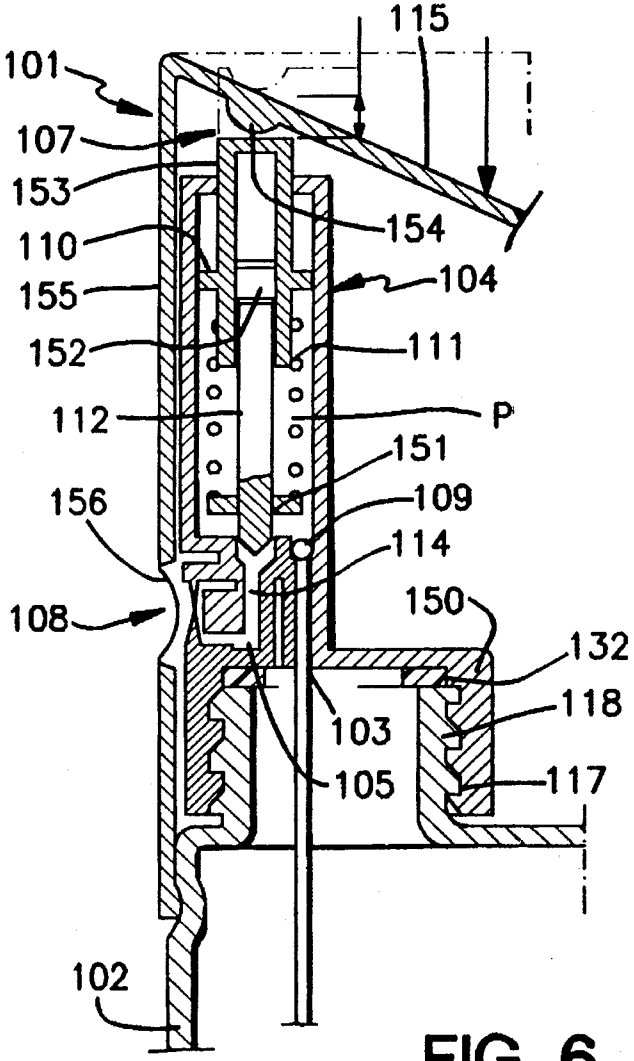
Figure 5:
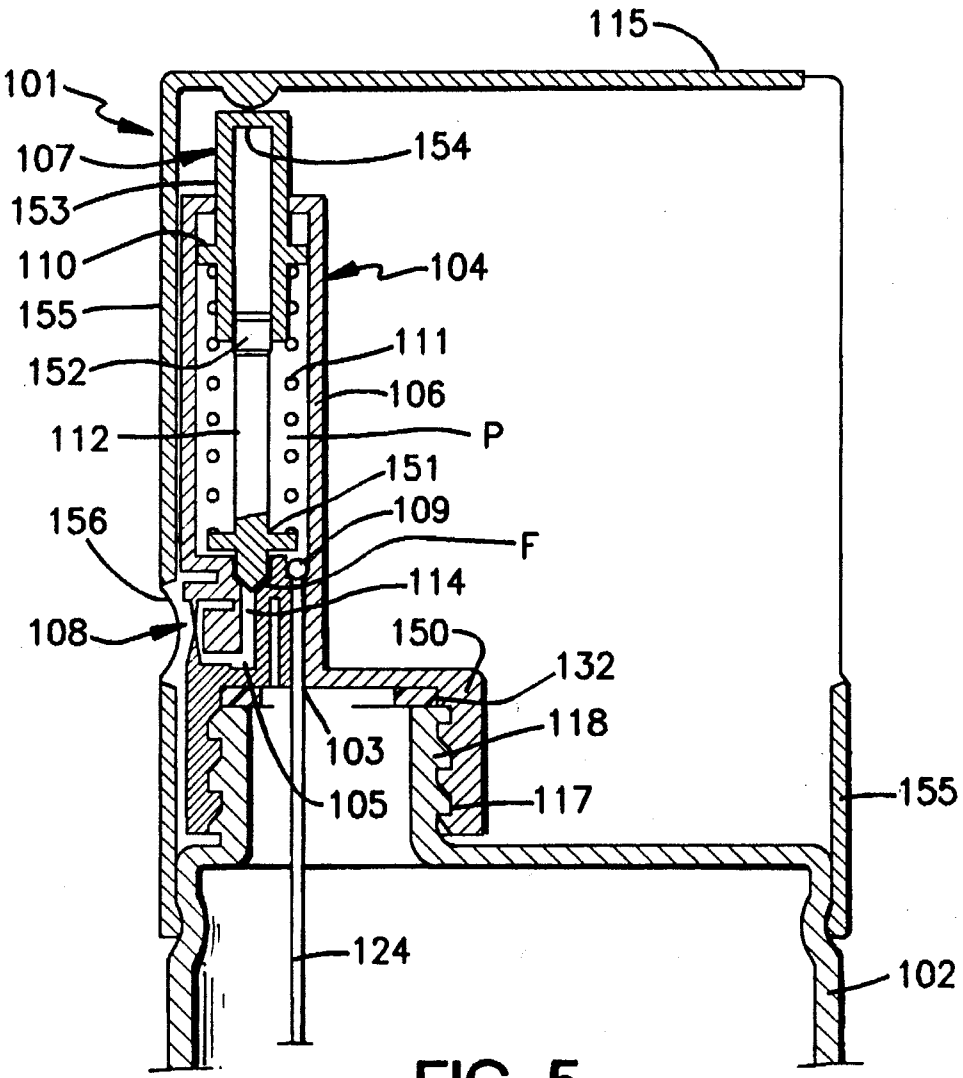
Figure 7:
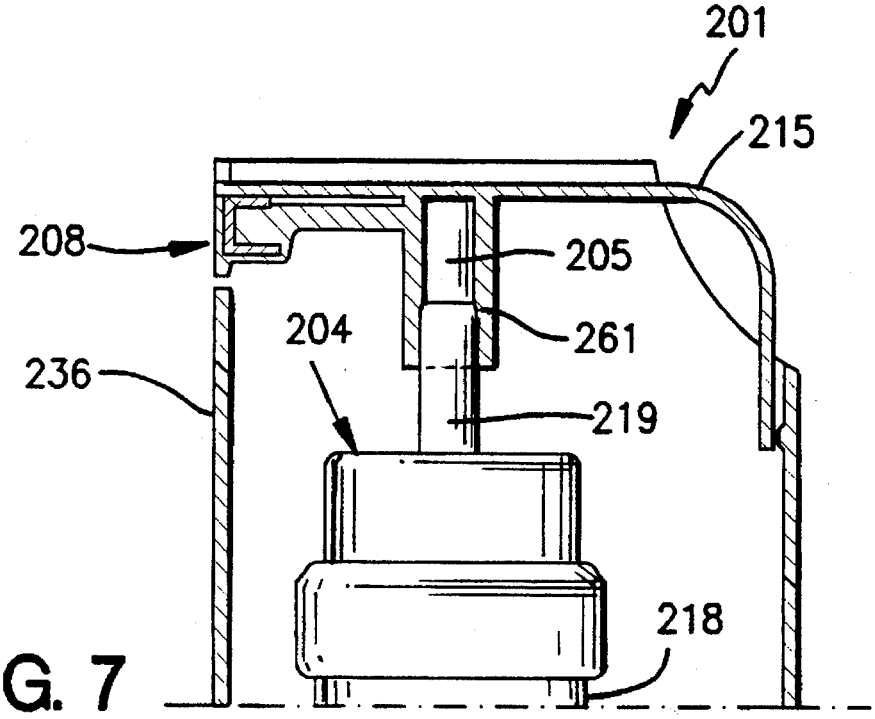
Figure 8:
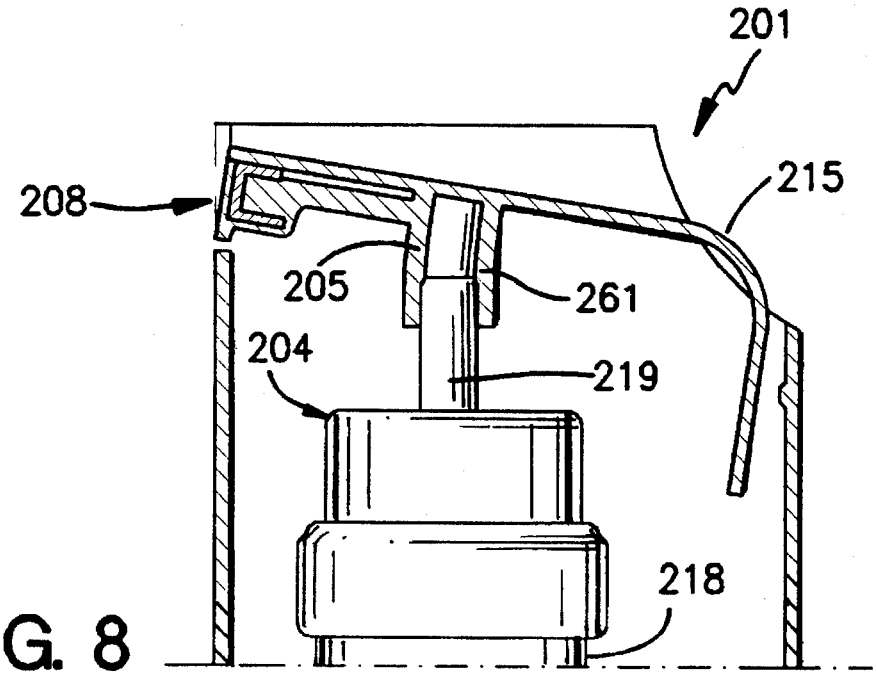

FIG. 5 is a second variant of the embodiment of a dispensing unit in accordance with the invention in its rest position, viewed in a partial longitudinal section, FIG. 6 is a partial longitudinal sectional view of the dispensing unit of FIG. 5 in the course of actuation, FIG. 7 is a partial longitudinal sectional view of a dispensing unit of the invention according to a third variant in its rest position, and FIG. 8 is a partial longitudinal sectional view of a dispensing unit of FIG. 7 in the course of actuation.

The dispensing unit represented in FIGS. 1 to 4 is designated by the reference numeral (1) as a whole. This unit is intended to spray a liquid in fine droplets, the liquid (L) being contained in a reservoir (2) or bottle, generally made of a plastic material. The cross-section of the reservoir (2) has an asymmetrical contour shown in FIG. 3. In its upper portion, the reservoir (2) is provided with means (7) for actuating the precompression pump (4), the pump being set, by means of a cup (17), on the collar (18) (or screwed onto the collar 18) emerging from the upper portion of the reservoir (2).

The means (7) for actuating the pump (4) are constituted by a push button (16) which has a spraying nozzle (8). This spraying nozzle (8) communicates with a delivery duct (5) which is itself delimited by the cylindrical wall of an actuating and spraying stem (19). The bottom of the delivery duct (5) has a cylindrical duct opening (14) that can be obturated by a generally elongate cylindrical spike (12) ending in the closing zone in a frustoconical shape forming, together with the edge of the duct opening (14), the closing means (F).

The pump (4) has a generally cylindrical body (6) provided at its lower portion with a portion with a smaller diameter (20), which is joined to a cylindrical disk (21)

having at its centre at least one passage opening (22); the disk (21) forms a seat for a non-return valve (9) for the liquid (L). This non-return valve (9) permits the one-way feeding of the pump (4) with the liquid (L). The valve (9) may be constituted by a flexible membrane, as in the example in question, or by a ball. A tube (23) with a smaller diameter is joined to the disk (21), into which tube a dip tube (24) is force-fitted whose free end extends as far as the bottom of the reservoir (2). The non-return valve (9) is held in its seat by a small plate (25) provided with passage openings (26).

At its upper portion, the body (6) of the pump (4) is provided with a side opening (27) allowing air to be taken up again inside the reservior (2). Inside the body (6) of the pump (4), the actuating stem (19) is connected to a cylindrical piston (10) provided at its upper and lower ends with a circular sealing lip (28*a*, 28*b*). In its portion that is in contact with the piston, the pump body (6) has an internal diameter $\phi$. Moreover, the pump body (6) is at its upper portion, catch engaged in a cylindrical retaining collar (29) having at its upper portion a radially inwardly extending cylindrical retaining flange (30) and at its lower portion a radially outwardly extending securing flange (31), an elastomeric cylindrical washer (32) sandwiched between the flange (31) and the upper portion of the neck (18) of the bottle when the pump (6) has been set in place by means of the cup (17).

The pump has, moreover, a helical restoring compression spring (11) which bears, at its lower portion, against a flange formed at the lower portion of the pump body (6), and at its upper portion against the flange of a sliding cylindrical component (33). The sliding component (33) has one or several ribs (40) establishing a communication between an upper precompression chamber (41) and a lower pumping chamber (44). The lower portion of the sliding component (33) has a reduced diameter, so that it can slide inside the helical spring (11) and is closed at its bottom. Mounted inside this lower portion is a helical spring (13) which operates by way of compression and bears against an annular portion (42) forming a piston, and which is joined to the obturating spike (12).

A cover cap (34) is catch-engaged in a peripheral groove (35) cut in the upper portion of the reservior (2). The cover cap (34) has a front face (36) which is provided with an opening (37) of an oval shape, which permits the ejection of the spray cone of the liquid (L) emanating from the nozzle (8). At its upper front face, the cap (34) has an articulation zone (38) in the form of a hinge, by means of which a lever arm (15) is pivotably joined to the cap (34). Joined to the lever arm (15), in the extension of the axis of the pump (4) is a semicircular bearing portion (39) which bears against the central upper face of the push button (16).

In a specific example of the embodiment, the reducing ratio obtained by the lever arm (15) is approximately 2 to 3. The actual dose D dispensed during the actuation of the pump (4) is 150 μl; the stroke C is 3.5 mm and the minimum pressure P necessary for opening the flexible closing means (F) is approximately $5.5\times10^5$ Pa. The ratio $D/\phi^2$ is 2.1; the efficiency R of the pump (4) is 75%; the ratio $D/\phi$. C is 5.

The unit represented in FIGS. 1 to 4 operates as follows. To prime the pump (4), the user presses several times on the lever arm (15) in the direction indicated by the arrow (f). On each operation, the non-return valve (9) is raised to allow a dose (D) of the liquid (L) to pass, and as the inside of the body (6) of the pump (4) is filled, air escapes through the opening (27). After having filled all the internal space of the pump body, the liquid (L) passes via the ribs (40) so as to subsequently fill the compression chamber (41). When the pressure P acting on the sealing lip (42) which is joined to the obturating spike (12), exceeds the values $5.5\cdot10^5$ Pa, the spike moves back against the bearing force exerted by the spring (13), thus freeing the duct (14); the dose of 150 μl of the liquid (L) thus delivered is carried through the delivery duct (5) in the direction towards the spraying nozzle (8); a spray is then produced in the form of a cone with droplets of the liquid with a granulometric size of less than or equal to 65 μm. The repetitive actuation of the lever arm (15) by the user allows the pump (4) to be operated at a high frequency without too much effort, and hence to obtain spraying that can be likened to continuous spraying.

FIGS. 5 and 6 show a second variant of the embodiment of a unit for dispensing a liquid in accordance with the invention, wherein the elements similar to those of the first variant bear reference numerals corresponding to those of FIGS. 1 and 4 increased by 100.

Thus a dispensing unit (101) is shown in a partial longitudinal section. It is constituted by a reservoir (102) which is joined at its upper portion to a neck (118). The neck (118) has fixing means in the form of an external thread cooperating with complementary fixing means provided in a cylindrical connecting ring (117). At its upper portion, the connecting ring (117) has a circular plate (150) provided with an elastomeric gasket (132). The plate (150) is surmounted by a cylindrical part hollowed out at its upper portion and forming the pump body (106) for the pump (104). A piston (110) slidably mounted in the pump body (106) bears against the upper end of a helical spring (111) and whose lower portion rests on a flange (151) which surrounds the lower portion of an obturating spike (112). The circular plate (150) is pierced so as to form a passageway between the reservoir (102) and the inside of the body (106) of the pump (104), forming the suction duct (103) to which is joined a dip tube (124) whose free end extends as far as the bottom of the reservoir (102).

At the upper end of the suction duct (103), provision is made for a non-return valve (109) in the form of a ball allowing the liquid (L) to be drawn up in the direction towards the pump (104) and preventing the liquid (L) from dropping into the reservoir (102). It is, moreover, possible to make provision for a device for bringing the reservoir (102) to atmospheric pressure.

The lower end of the spike (112) has a frustoconical (or equivalent) shape that cooporates with an opening (114) giving access to a delivery duct (105) which itself leads to a nozzle (108). The upper portion of the obturating spike (112) is formed in the shape of a piston (152) sliding inside a tube (153) which is connected on either side concentrically to the piston (110). The upper portion of the tube (153) emerges from the pump body (106) and has an opening (154) for communicating with atmospheric pressure.

As may be seen in particular in FIG. 6, the piston (110) joined to the tube (153) is movable and may, during actuation, execute a stroke indicated by the reference C. This actuation, causing the piston (110) to be lowered, is effected by pressing in the direction of arrow f on the lever arm (115) which is articulated by a hinge (154) and joined to a cover cap (155); this cap (155) is catch-engaged at its lower portion by a bead/groove system (160) to the reservoir (102). Opposite the nozzle (108), a cylindrical cutout (156) has been cut in the cover cap (155) allowing the spray cone of the liquid (L) to pass.

The use of this dispensing unit in accordance with FIGS. 5 and 6 is effected in a manner similar to the embodiment described with reference to FIGS. 1 to 4. FIGS. 7 and 8 describe a third variant of the embodiment of a liquid dispensing unit in accordance with the invention. All the elements similar to those of the variant of FIG. 1 bear the same reference numerals increased by 200. The dispensing unit (201) of FIGS. 7 and 8 is distinguished from that of FIG. 1 by the fact that the lever arm (215) has a deformable and bent tube (261) catch-engaged on one end of the actuating and spraying stem (219) of the pump (204). This tube (261) ensures the communication of the nozzle (208) and of the delivery duct (205) delimited by the walls of the stem (219). This unit operates in a way similar to that described above.

It shall be duly understood that the precompression pump used may be chosen from those which have a design similar to those described, or constituted by elements performing a similar function.

I claim:

1. In a unit (1, 101) for dispensing a liquid (L) capable of spraying this liquid (L) in the form of droplets in a virtually continuous manner, comprising a reservoir (2, 102) containing the liquid to be sprayed, this reservoir (2, 102) communicating with a feeder duct (3, 103) of a precompression pump (4, 104) provided with a delivery duct (5, 105) which communicates with a spraying nozzle (8, 108); means (7, 107) for actuating the pump (4, 104) and spraying this liquid (L), this pump (4, 104) comprising a cylindrical body (6, 106) joined to the said feeder duct (3, 103), and a cylindrical piston (10, 110) capable of sliding in a portion with a diameter ϕ of the body (6, 106) of the pump 4, 104) under the actuation of the actuating means (7, 107) against resillent restoring means (11, 111) along a stroke C; means (9, 109) for preventing the return of the liquid into the feeder duct; and flexible closing means (12, 112; 13) provided for releasing a dispensing duct (14, 114) in the pump (4, 104) when the pressure P obtaining inside the body (6, 106) of the pump (4, 104) following the actuation of the actuating means (7, 107) exceeds a specified value, this pump (4, 104) having an efficiency R and delivering on each actuation, a dose D of liquid; wherein the stroke C of the piston (10, 110) is in the range of from 2 to 5 mm.

2. A unit according to claim 1, characterized in that the ratio ϕ/C is at least equal to 1.45 for a dose D in the range of 110 to 170 μl.

3. A unit according to claim 2, wherein the nozzle (108) is mounted in the body of the pump (104), the actuating means (107) then being constituted by a stem having a first end and a second end emerging from the body (106) of the pump (104) and connected via the first end inside the body of the pump (104) to the piston (110), the second end being free outside the pump (104) and in contact with the lever arm (115).

4. A unit according to claim 2, wherein the nozzle (208) is mounted in the reducing system (215) provided with a deformable bent tube (261) connected to a manipulating and spraying stem (219) emerging from the body of the pump (204), the stem causing the delivery duct (205) and the nozzle to communicate.

5. A unit according to claim 2, wherein that the diameter ϕ of said portion of the pump body is in the range of 3 to 16 mm.

6. A unit according to claim 1, further comprising a hollow sliding cylindrical component (33) disposed within said cylindrical body (6) and against which said resilient restoring means (11) bears, means (40) on said sliding cylindrical component (30) establishing communication between an upper precompresion chamber (41) and a lower pumping chamber (44) in said cylindrical body (6), and compression spring means (13) disposed within said sliding cylindrical components (33) and acting on said flexible closing means (12) in a direction to close said dispensing duct (14).

7. A unit according to claim 6, and a side opening (27) through said cylindrical body (6) to prevent the escape of air from within said cylindrical body (6).

8. In a unit (1, 101) for dispensing a liquid (L) capable of spraying this liquid (L) in the form of droplets in a virtually continuous manner, comprising a reservoir (2, 102) containing the liquid to be sprayed, this reservoir (2, 102) communicating with a feeder duct (3, 103) of a precompression pump (4, 104) provided with a delivery duct (5, 105) which communicates with a spraying nozzle (8, 108); means (7, 107) for actuating the pump (4, 104) and spraying this liquid (L), this pump (4, 104) comprising a cylindrical body (6, 106) joined to the said feeder duct (3, 103), and a cylindrical piston (10, 110) capable of sliding in a portion with a diameter ϕ of the body (6, 106) of the pump 4, 104) under the actuation of the actuating means (7, 107) against resilient restoring means (11, 111) along a stroke C, means (9, 109) for preventing the return of the liquid into the feeder duct; and flexible closing means (12, 112; 13) provided for releasing a dispensing duct (14, 114) in the pump (4, 104) when the pressure P obtaining inside the body (6, 106) of the pump (4, 104) following the actuation of the actuating means (7, 107) exceeds a specified value, this pump (4, 104) having an efficiency R and delivering on each actuation, a dose D of liquid; the improvement the ratio ϕ/C is at least equal to 1.45 for a dose D in the range of 110 to 170 μl.

9. A unit according to claim 8, wherein the pressure (P) necessary for releasing the dispensing duct for the liquid is at least equal to $5\times10^5$ Pa.

10. A unit according to claim 8, wherein the ratio $D/\phi C^2$ is at most equal to 3.3.

11. A unit according to claim 8, wherein the ratio D/ϕ C is in the range of 4.5 to 5.5.

12. A unit according to claim 8, wherein the actuating means (7, 107) are associated with a reducing system in the form of a lever arm (15, 115).

13. A unit according to claim 8, wherein the reducing ratio of the lever arm (15, 115) is in the range of 1 to 5.

14. A unit according to claim 8, wherein the efficiency R of the pump (4, 104) is higher than 50%.

15. A unit according to claim 8, wherein the spraying nozzle (8) is mounted on a movable push button (16) which constitutes the actuating means (7), the push button being connected to a manipulating and spraying stem (19) emerging from the body (6) of the pump (4).

16. A unit according to claim 8, further comprising a hollow sliding cylindrical component (33) disposed within said cylindrical body (6) and against which said resilient restoring means (11) bears, means (40) on said sliding cylindrical component (30) establishing communication between an upper precompression chamber (41) and a lower pumping chamber (44) in said cylindrical body (6), and compression spring means (13) disposed within said sliding cylindrical components (33) and acting on said flexible closing means (12) in a direction to close said dispensing duct (14).

17. A unit according to claim 8, and a side opening (27) through said cylindrical body (6) to prevent the escape of air from within said cylindrical body (6).

* * * * *